US010648263B2

(12) United States Patent
Markel et al.

(10) Patent No.: US 10,648,263 B2
(45) Date of Patent: May 12, 2020

(54) DOWNHOLE PLUG ASSEMBLY

(71) Applicant: Schlumberger Technology Corporation, Sugar Land, TX (US)

(72) Inventors: Daniel C. Markel, Pearland, TX (US); Tauna Lea Leonardi, Pearland, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 164 days.

(21) Appl. No.: 15/383,768

(22) Filed: Dec. 19, 2016

(65) Prior Publication Data

US 2018/0171744 A1 Jun. 21, 2018

(51) Int. Cl.
*E21B 23/01* (2006.01)
*E21B 33/12* (2006.01)

(52) U.S. Cl.
CPC ..... *E21B 23/01* (2013.01); *E21B 33/1212* (2013.01)

(58) Field of Classification Search
CPC ..... E21B 33/128; E21B 34/14
See application file for complete search history.

(56) References Cited

U.S. PATENT DOCUMENTS 4,292,988 A * 10/1981 Montgomery ..... E21B 21/10 137/68.17
7,353,879 B2 * 4/2008 Todd ..... E21B 23/00 166/317
7,464,764 B2 * 12/2008 Xu ..... E21B 34/14 166/317
7,775,279 B2 8/2010 Marya et al.
8,211,247 B2 7/2012 Marya et al.
10,450,829 B2 10/2019 Melenyzer et al.
2010/0101803 A1 * 4/2010 Clayton ..... E21B 29/02 166/376
2010/0101806 A1 * 4/2010 Millet ..... E21B 33/129 166/382
2011/0192607 A1 * 8/2011 Hofman ..... E21B 34/14 166/317
2011/0278010 A1 * 11/2011 Fehr ..... E21B 33/124 166/308.1
2012/0261115 A1 * 10/2012 Xu ..... E21B 33/12 166/193
2013/0062063 A1 * 3/2013 Baihly ..... E21B 23/04 166/297
2014/0014371 A1 * 1/2014 Jacob ..... E21B 33/129 166/382

(Continued)

FOREIGN PATENT DOCUMENTS

WO 2015/184041 A1 12/2015
WO 2015/184043 A1 12/2015

(Continued)

*Primary Examiner* — Shane Bomar

(57) ABSTRACT

A technique includes running a plug assembly inside a tubing string of a well; deploying an untethered object in the tubing string; and communicating the untethered object into a passageway of the plug assembly to land the untethered object in a seat of the plug assembly. The passageway has a maximum cross-sectional dimension that is larger than a maximum cross-sectional dimension of the untethered object. The technique includes using the landed untethered object to form a fluid barrier in the tubing string.

12 Claims, 6 Drawing Sheets

(56) References Cited

U.S. PATENT DOCUMENTS

| | | | | |
|---|---|---|---|---|
| 2014/0060837 | A1* | 3/2014 | Love | E21B 43/26 166/297 |
| 2014/0202708 | A1* | 7/2014 | Jacob | E21B 23/01 166/376 |
| 2014/0246209 | A1* | 9/2014 | Themig | E21B 43/14 166/374 |
| 2015/0369040 | A1* | 12/2015 | George | E21B 34/063 166/250.08 |
| 2016/0047193 | A1* | 2/2016 | Snider | E21B 23/06 166/297 |
| 2016/0076341 | A1* | 3/2016 | Burguieres | E21B 41/0007 166/340 |
| 2016/0333187 | A1* | 11/2016 | Bauer | C09D 5/00 |
| 2016/0356137 | A1* | 12/2016 | Hardesty | E21B 34/063 |
| 2018/0128082 | A1* | 5/2018 | Hollan | E21B 34/14 |
| 2018/0187060 | A1* | 7/2018 | Okura | C09K 8/72 |
| 2019/0106961 | A1* | 4/2019 | Hardesty | E21B 33/128 |

FOREIGN PATENT DOCUMENTS

| | | | |
|---|---|---|---|
| WO | 2016/085798 | A1 | 6/2016 |
| WO | 2016/085804 | A1 | 6/2016 |
| WO | 2016/085806 | A1 | 6/2016 |

* cited by examiner

DOWNHOLE PLUG ASSEMBLY

BACKGROUND

For purposes of preparing a well for the production of oil or gas, at least one perforating gun may be deployed into the well via a conveyance mechanism, such as a wireline, slickline or a coiled tubing string. The shaped charges of the perforating gun(s) are fired when the gun(s) are appropriately positioned to perforate a casing of the well and form perforating tunnels into the surrounding formation. Additional operations may be performed in the well to increase the well's permeability, such as well stimulation operations and operations that involve hydraulic fracturing. The above-described perforating and stimulation operations may be performed in multiple stages of the well.

The above-described operations may be performed by actuating one or more downhole tools (perforating guns, sleeve valves, and so forth) and by forming one or more fluid-diverting fluid barriers downhole in the well.

SUMMARY

The summary is provided to introduce a selection of concepts that are further described below in the detailed description. This summary is not intended to identify key or essential features of the claimed subject matter, nor is it intended to be used as an aid in limiting the scope of the claimed subject matter.

In an example implementation, a technique includes running a plug assembly inside a tubing string of a well; deploying an untethered object in the tubing string; and communicating the untethered object into a passageway of the plug assembly to land the untethered object in a seat of the plug assembly. The passageway has a maximum cross-sectional dimension that is larger than a maximum cross-sectional dimension of the untethered object. The technique includes using the landed untethered object to form a fluid barrier in the tubing string.

In another example implementation, a technique includes running a plug assembly inside a tubing string of a well. The technique includes axially translating a seal retainer of the plug assembly inside a central passageway of a body of the plug assembly to cause a sealing element of the plug assembly to be energized against a wall of the tubing string and be energized against the body of the plug assembly.

In accordance with another example implementation, a plug assembly that is usable with a well includes a tubular main body, a sealing ring to circumscribe the main body and a tubular seal retainer. The tubular seal retainer axially translates inside a central passageway of the body to cause the sealing ring to be energized against a wall of a tubing string surrounding the sealing ring and be energized against the main body.

In accordance with yet another example implementation, an apparatus includes a tubing string; a conveyance mechanism; and a plug assembly to be run downhole inside the tubing string using the conveyance mechanism; and a setting tool. The plug assembly includes a tubular main body, a sealing ring to circumscribe the main body and a tubular sealed retainer. The tubular sealed retainer axially translates inside a central passageway of the body to cause the sealing ring to be energized against a wall of the tubing string surrounding the sealing string and be energized against the main body. The setting tool forces the seal retainer against the sealing ring to radially expand the sealing ring to energize the sealing ring against the tubing string and axially translate the sealing ring to energize the sealing ring against the main body.

Advantages and other features will become apparent from the following drawings, description and claims.

DETAILED DESCRIPTION

Figure 1:
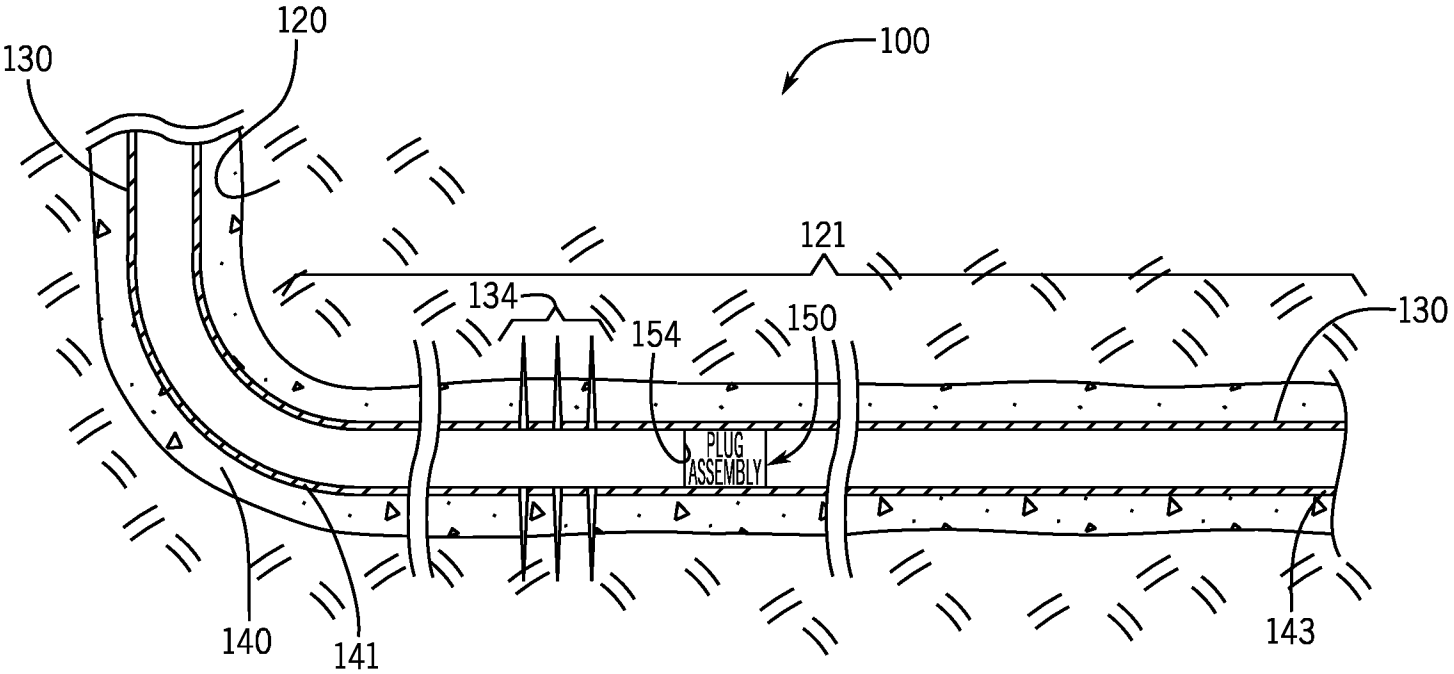
FIG. 1 is a schematic diagram of a well illustrating a plug assembly installed in a tubing string.

In the following description, numerous specific details are set forth but implementations may be practiced without these specific details. Well-known circuits, structures and techniques have not been shown in detail to avoid obscuring an understanding of this description. "An implementation," "example implementation," "various implementations" and the like indicate implementation(s) so described may include particular features, structures, or characteristics, but not every implementation necessarily includes the particular features, structures, or characteristics. Some implementations may have some, all, or none of the features described for other implementations. "First", "second", "third" and the like describe a common object and indicate different instances of like objects are being referred to. Such adjectives do not imply objects so described must be in a given sequence, either temporally, spatially, in ranking, or in any other manner. "Coupled", "connected", and their derivatives are not synonyms. "Connected" may indicate elements are in direct physical or electrical contact with each other and "coupled" may indicate elements co-operate or interact with each other, but they may or may not be in direct physical or electrical contact. Also, while similar or same numbers may be used to designate same or similar parts in different figures, doing so does not mean all figures including similar or same numbers constitute a single or same implementation. Although terms of directional or orientation, such as "up," "down," "upper," "lower," "uphole," "downhole," and the like, may be used herein for purposes of simplifying the discussion of certain implementations, it is understood that these orientations and directions may not be used in accordance with further example implementations.

In accordance with example implementations, a plug assembly may be run into a tubing string (a casing string, for example) of a well for purposes of forming a fluid barrier at a desired, or target, downhole location. For example, the plug assembly may be run downhole inside the central passageway of the tubing string on a conveyance mechanism, such as a coiled tubing string or a wireline. The plug assembly may be mounted to a setting tool, and when the plug assembly is at the target location, the setting tool may be to exert forces on the plug assembly to radially expand the assembly so that a gripping member of the plug assembly engages the wall of the tubing string to anchor the plug assembly in place. Moreover, in the setting of the plug assembly, a sealing member of the plug assembly may be radially expanded to form a fluid seal between the plug assembly and the tubing string wall. The plug assembly may have a through passageway, and thus, when initially set, does not form the fluid barrier. To form the fluid barrier, an untethered object (an activation ball, for example) inside the central passageway of the tubing string passageway so that the untethered object travels down through the tubing string passageway to land in a seat of the plug assembly to block the assembly's passageway.

The downhole fluid barrier may be used to perform a well stimulation operation. For example, a hydraulic fracturing operation may rely on the fluid barrier to divert fluid into the surrounding formation.

In example implementations that are described herein, the plug assembly may be a thin wall plug assembly. As its name implies, the thin wall plug assembly has a relatively thin housing wall, which allows for a relatively large inner diameter for the through passageway of the plug assembly. The relatively large passageway, in turn, is beneficial for allowing equipment to pass through the plug assembly after the plug assembly is set inside the tubing string. A constraint in using a thin wall plug assembly is that the housing wall should have a sufficient thickness to impart a mechanical integrity to withstand the forces that exerted on the assembly after the fluid barrier is formed. Example implementations are described herein in which a thin wall plug assembly has an internal seat that is constructed to position the untethered object inside the plug assembly in a manner that allows the plug assembly to have a relatively thinner housing wall, as compared to conventional designs.

As also described herein, in accordance with example implementations, a plug assembly may include a ratcheting seal retainer, which is used to both 1. radially expand a seal ring of the plug assembly to form a fluid seal between the plug assembly and the outer tubing string; and 2. axially translate the seal ring to form a fluid seal between the seal ring and the main housing of the plug assembly. As described further herein, the seal retainer has a relatively simple design, moves independently with respect to the main body, and allows axial and radial forces to be created to both anchor the plug assembly in place and form the above-described fluid seals. Moreover, as described herein, one or multiple components of the plug assembly may be constructed from degradable, or dissolvable, materials. This allows downhole fluids that are present in the well (as well as possibly other fluids that are introduced from the Earth surface) to disintegrate the plug assembly over a relatively short interval of time (i.e., remove the plug assembly after the plug assembly has performed its function of forming a fluid barrier and the associated downhole operation is over).

As a more specific example, FIG. 1 depicts a well 100 in accordance with some implementations. The well 100 includes a laterally extending wellbore 120, which traverses one or more hydrocarbon-bearing formations. For the specific implementation that is depicted in FIG. 1, the wellbore 120 is lined and supported by a tubing string 130. The tubing string 130 may be cemented to the wellbore 120 (i.e., the tubing string 130 may be a casing); or the tubing string 130 may be anchored or secured, to the surrounding formation(s) by one or multiple packers (i.e., the tubing string 130 may be installed in an "open hole wellbore"). For the specific example of FIG. 1, the tubing string 130 is a casing that has been run into the wellbore 120, and a cementing operation has been performed to place cement 140 in the annular region between the exterior of the casing and the wall of the wellbore 120.

It is noted that although FIG. 1 depicts a laterally extending wellbore, the technique systems that are disclosed herein may likewise apply to vertically extending wellbores. Moreover, in accordance with example implementations, the well 100 may contain multiple wellbores, which contain tubing strings that are similar to the tubing string 130 of FIG. 1. The well 100 may be a subsea well or may be a terrestrial well depending on the particular implementation. Additionally, the well 100 may be an injection well or may be a production well, depending on the particular implementation. Thus, many implementations are contemplated, which are within the scope of the appended claims.

As depicted in FIG. 1, the tubing string 130 extends from a heel end 141 of a lateral segment 121 of the wellbore 120 to a toe end 143 of the segment 121. The lateral segment 121 may be associated with multiple zones, or stages, which may be isolated and stimulated separately.

For the specific example depicted in FIG. 1, a plug assembly 150 has been set and thus, anchored, or secured, to the tubing string 130 at a target downhole location. For this example, the plug assembly 150 is located at the downhole end of a stage, or zone, of the well 100 in which a well stimulation operation is to be performed. As depicted in FIG. 1, hydraulic communication with the surrounding formation may have been enhanced through, for example, a prior perforating operation that formed perforations 134 that penetrate the wall of the tubing string 130 and extend into the surrounding formation. Hydraulic communication may be enhanced using other techniques (abrasive jetting operations, for example).

An untethered object (an activation sphere, or ball, as an example) may be deployed inside the central passageway of the tubing string 130 to land in a seat 154 of the plug assembly 150 for purposes of forming a fluid barrier inside the tubing string 130 above the plug assembly 150. For example, after the fluid barrier is formed, fracturing fluid may be pumped into the tubing string 130, so that the fluid barrier diverts the fluid into the surrounding formation.

In the context of this application, an "untethered object" refers to an object that is communicated downhole through the passage of a tubing string along at least part of its path without the use of a conveyance line (a slickline, a wireline, a coiled tubing string, and so forth). As examples, the untethered object may be a ball (or sphere), a dart or a bar. Regardless of its particular form, the untethered object travels through the passageway of the tubing string to land in the object catching seat of the plug assembly to form a corresponding fluid obstruction, or barrier.

Figure 2:
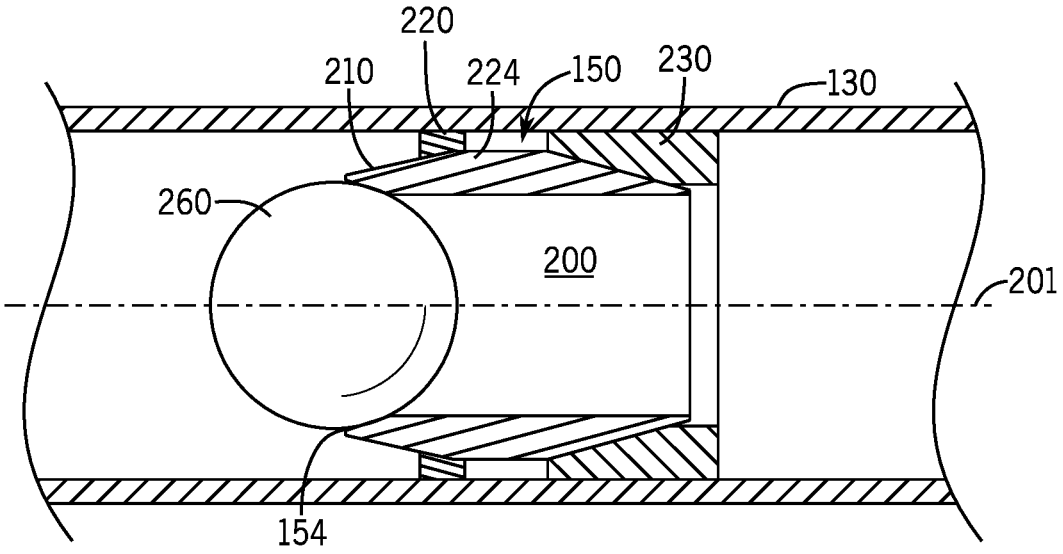
FIG. 2 is a cross-sectional view of a well illustrating a thin wall plug assembly.

One way to construct a plug assembly that has a through passageway is to form the object catching seat 154 of the assembly at or near the uphole end of the assembly (i.e., at the upper end of the through passageway). For example, FIG. 2 depicts the plug assembly 150 with such a configuration. In this design, the plug assembly 150 includes a tubular main housing, or body 224, which circumscribes a longitudinal axis 201 and has a through passageway 200 extending along the axis 201. The plug assembly 150 further contains an annularly extending seal element 220 that forms a fluid seal between the plug assembly 150 and the tubing string 130 when the assembly 150 is set. Moreover, for this example, the plug assembly 150 includes a slip, or gripping element 230, which anchors the plug assembly 150 to the tubing string 130 when the assembly 150 is set. At its uphole end 210, the plug assembly 150 includes the object catching seat 154, which circumscribes the longitudinal axis 201 of the assembly 150 and is constructed to receive and catch an untethered object, which is an activation ball 260 for this example. As depicted in FIG. 2, the activation ball 260 has an outer diameter that is larger than the inner diameter (ID) of the through passageway 200.

The plug assembly design that is depicted in FIG. 2 may produce forces on the main body 224, which may cause the main body 224 to severely yield and fail at high pressure if the body 224 is not thick enough to exhibit the requisite mechanical integrity. This design constrains the minimum thickness of the main body 224, and therefore, the overall thickness of the plug assembly 150.

Figure 3:
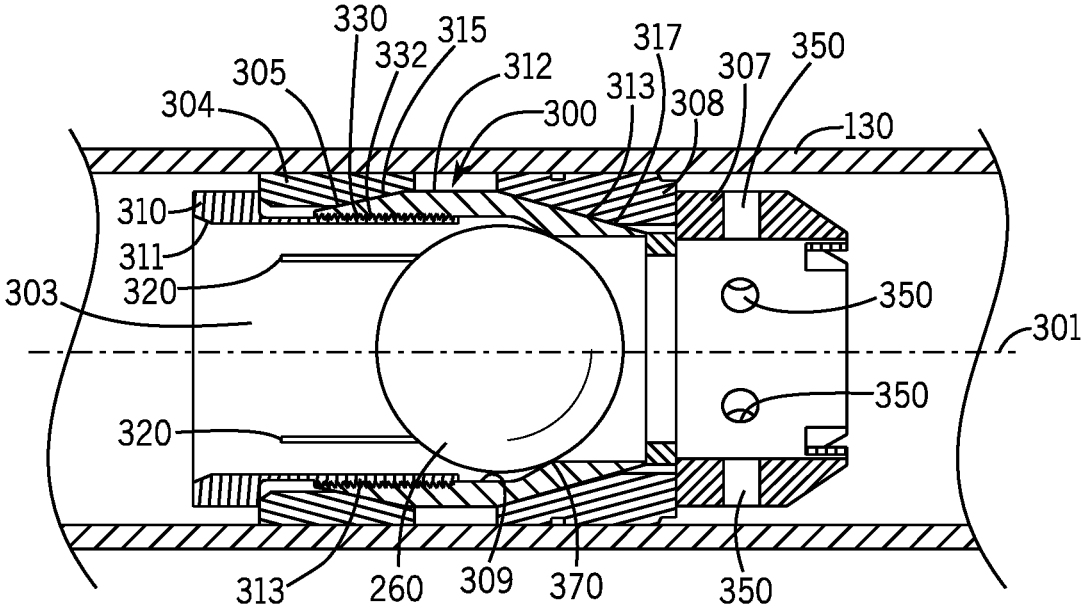
FIG. 3 is a cross-sectional view of a well illustrating a thin wall plug assembly according to an example implementation.

In accordance with example implementations, a plug assembly may be constructed to receive an untethered object inside the assembly, instead of at a seat formed on the uphole end of the assembly. More specifically, referring to FIG. 3, in accordance with example implementations, a thin wall plug assembly 300 has a through passageway 303 with an internal diameter (ID) that is larger than the maximum cross-sectional dimension of the untethered object that received by the plug assembly 300 for purposes of forming a fluid barrier inside the tubing string 130. In this manner, for the example implementation of FIG. 3, the through passageway 303 of the plug assembly 300 has an ID that is larger than the outer diameter of an activation ball 260 that is received by the plug assembly 300. As depicted in FIG. 3, the through passageway 303 extends along a longitudinal axis 301, and, in general, the components of the plug assembly 300 generally circumscribe the longitudinal axis 301.

As depicted in FIG. 3, in accordance with example implementations, the plug assembly 300 includes a tubular main body 312 that circumscribes the longitudinal axis 301 and has a restricted portion to form a corresponding annular seat 370 to catch the activation ball 260 to form a corresponding fluid barrier. As shown in FIG. 3, the seat 370 is disposed within the through passageway 303 of the plug assembly 300; and in accordance with example implementations, the seat 370 is constructed to form a surface that does not form a wedge fit with the activation ball 260 (i.e., the seat 370 does not form an interference fit with the activation ball 260). In other words, for a lateral wellbore, the activation ball 260 may fall out of the seat 370 when pressure is released on the ball 260. This design significantly reduces stress on the main body 312, thereby allowing a reduced radial thickness for the plug assembly 300.

In an example implementation, the ID of the plug assembly 300 may be approximately 2.5 inches, and the ID of the tubing string 130 may being approximately 3 inches. It is noted that this example is merely to demonstrate the relatively thinness of the plug assembly 300, as other dimensions may be used, depending on the particular application, as can be appreciated by one of ordinary skill in the art.

In accordance with some implementations, the plug assembly 300 includes a seal retainer 310, which is constructed to be received inside a longitudinal central passageway 309 of the main body 312. As shown in FIG. 3, the seal retainer 310 and the main body 312 are tubular members, which circumscribe a longitudinal axis 301 of the assembly 300. The plug assembly 300 further includes a seal element 304 and a slip, or gripping member 308. Moreover, as depicted in FIG. 3, in accordance with some implementations, a downhole end 313 of the seal retainer 310 may include outer, annularly extending ratcheting teeth 330 that are constructed to engage corresponding inner, annularly extending ratcheting teeth 332 of the main body 312.

The main body 312 may include an outer, upwardly facing annular inclined surface 315, which is constructed to engage an inner, downwardly facing annular inclined surface 305 of the seal element 304. The gripping member 308 has an inner, upwardly facing annular inclined surface 317 that is constructed to contact an outer, downwardly facing annular inclined outwardly annular inclined surface 313 of the main body 312. Due to this arrangement, the seal retainer 310 may be axially translated toward the main body 312 using forces that are exerted by a setting tool (as described further below) to set the plug assembly 300. In this manner, in response to the seal retainer 310 being axially translated along the longitudinal axis 301 toward the main body 312, contact of the surfaces 305 and 315 produces axial and radial forces on the seal element 304 to energize the seal element 304 against the tubing string wall and energize the seal element against the main body 312. As a result, fluid seals are formed between the seal ring 304 and the tubing string wall and between the seal ring 304 and the main body 312.

Among the other features of the plug assembly 300, as shown in FIG. 3, the seal retainer 310 may include longitudinally extending slots 320, which permit the downhole end 313 of the retainer 310 to flex for purposes allowing the seal retainer 310 to form both a threaded connection and a ratchet connection with the main body 312, as further described below. The plug assembly 300 may also include an end piece 307 that is initially secured to the setting tool via shear pins (not shown) that extend into radial openings 350 of the end piece 307. The end piece 307 serves as a stop that is used to expand the seal element 304 and gripping member 308.

In accordance with some implementations, the wall plug assembly 300 may be set inside the tubing string 139 as follows. In accordance with some implementations, the plug assembly 300 may be run downhole on a conveyance mechanism, such as a coiled tubing, wireline, slickline, and so forth. For example, in accordance with some implementations, the plug assembly 300 may be run into the tubing string 130 on a coiled tubing string, which contains a setting tool (not shown) that extends inside the through passageway 303 of the assembly 300. For purposes of running the plug assembly 300 downhole, the setting tool may be initially attached to the plug assembly 300 by shear pins that extend into the openings 350 of the end piece 307. When run downhole, the plug assembly 300 is placed in its run-in-hole state, a state in which the seal element 304 and gripping member 308 are radially contracted. Moreover, in the run-in-hole state of the plug assembly 300, the seal retainer 310 is not axially located inside the main body 312 as far as depicted in FIG. 3. Instead, for the run-in-hole state, a relatively few ratcheting teeth 330 may engage a few ratcheting teeth 332 of the main body 312.

When at the appropriate downhole position, the setting tool may be actuated to exert a downward force to axially translate the seal retainer 310 toward the main body 312, to thereby radially expand the seal element 304 and gripping member 308. Thus, the setting tool exerts a downward force on the seal retainer 310. When this downward force exceeds a predetermined limit, shear pins (in the openings 350)

shear, which release the setting tool from the plug assembly 300 thereby allowing the setting tool to be released from the now set plug assembly 300 and retrieved uphole.

Figure 4:
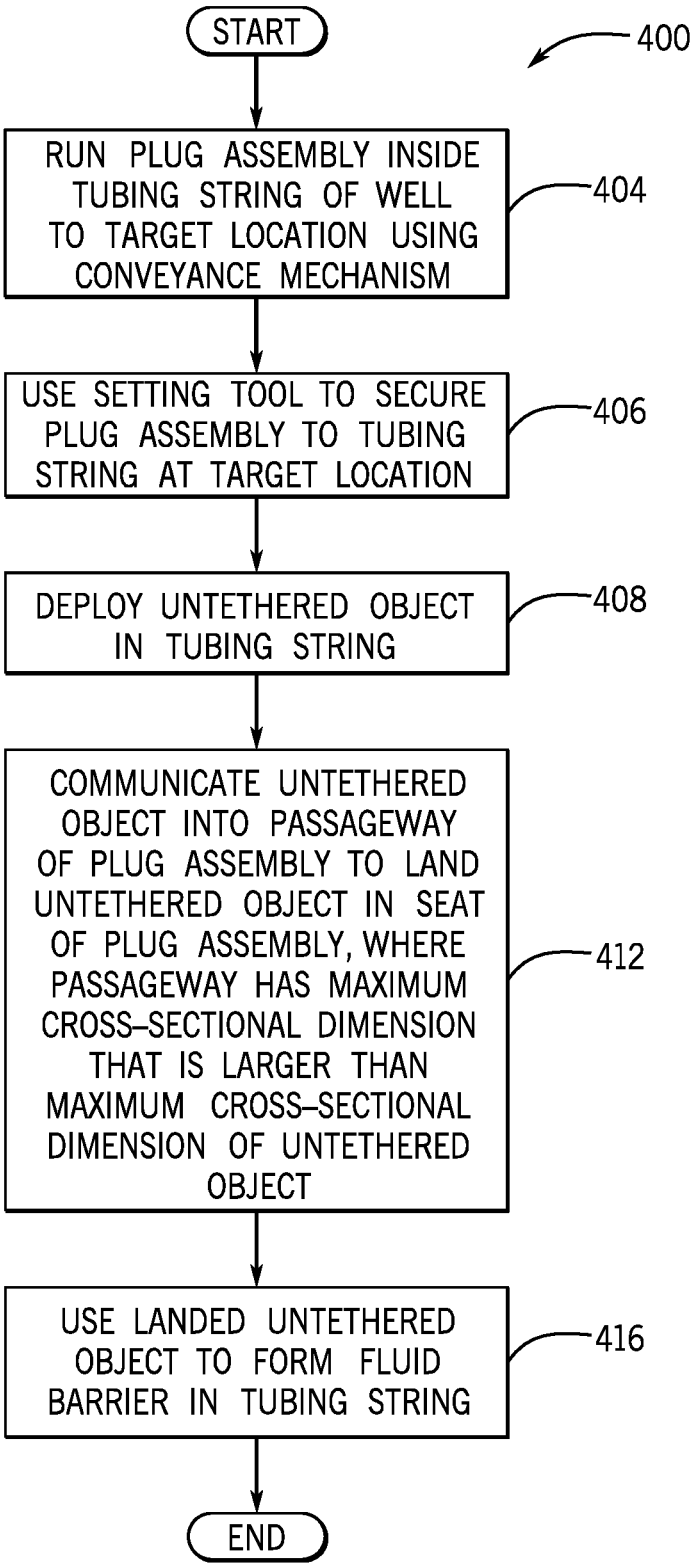
FIG. 4 is a flow diagram depicting a technique to use a thin wall plug assembly in a well according to an example implementation.

Thus, referring to FIG. 4, in accordance with example implementations, a technique 400 includes running (block 404) a plug assembly inside a tubing string of a well to a target location using a conveyance mechanism; and using (block 406) the setting tool to secure the plug assembly to the tubing string at the target location. An untethered object may be deployed (block 408) in the tubing string and communicated (block 412) into a passageway of the plug assembly to land the untethered object in a seat of the plug assembly. The passageway has a maximum cross-sectional dimension that is larger than the maximum cross-sectional dimension of the untethered object. The landed untethered object may then be used to form a fluid barrier in the tubing string pursuant to block 416.

Figure 5A:
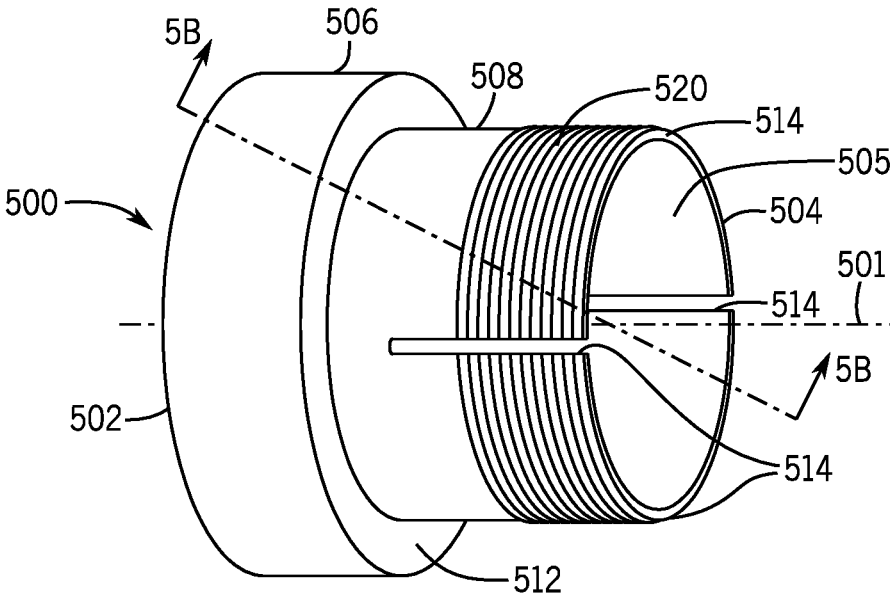
FIG. 5A is a perspective view of a seal retainer according to an example implementation.
Figure 5B:
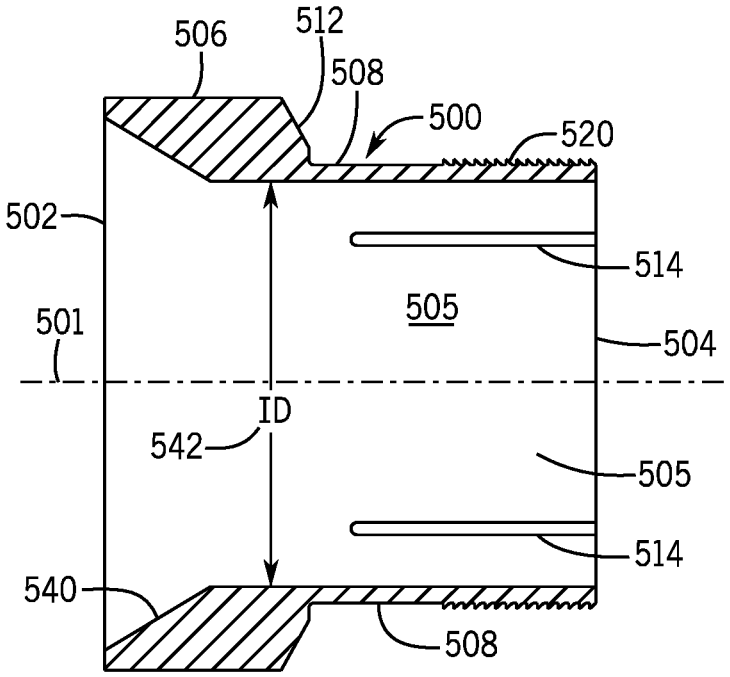
FIG. 5B is a cross-sectional view of the seal retainer of FIG. 5A according to an example implementation.

Referring to FIGS. 5A and 5B, in accordance with some implementations, a seal retainer 500 may be used. In general, the seal retainer 500 is a tubular member, which circumscribes a longitudinal axis 501. At an uphole end 502 of the seal retainer 500, the seal retainer 500 may contain a relatively large inward, upwardly facing inclined surface 540 for purposes of guiding an untethered object (such as an activation ball, for example) into an inner passageway 505 of the seal retainer 500. In general, the seal retainer 500 may have a larger diameter upper section 506 (containing the inclined surface 540) and a smaller diameter lower section 508, which contains outer, ratcheting teeth 520 that are arranged near the downhole end 504 of the retainer 500. The lower portion 508 has an ID 542 that closely corresponds to the outer dimension of the untethered object that is received/caught by the plug assembly containing the seal retainer 500, but the ID 542 is larger than the maximum cross-sectional dimension of the untethered object.

In accordance with example implementations, the teeth 520 may be spirally wound about the longitudinal axis 510 to serve both as a thread (to mate with an inner thread of the main body of the plug assembly) and as a ratcheting mechanism (to form a ratcheting connection with the inner thread of the main body). In this manner, the seal retainer 500 may contain longitudinal slots 515, which allow the end 504 of the retainer 500 to be slightly radially compressed. This allows the teeth 500 to form a ratcheting engagement with the teeth of the main body as the seal retainer 500 is pushed into the main body.

In this manner, for purposes of preparing a plug assembly that contains the seal retainer 500 for deployment into the well, the seal retainer 500 may be threaded into the main body (engaging corresponding ratcheting teeth/threads). For purposes of setting the plug assembly, the setting tool may exert forces to longitudinally translated (and not rotate) the seal retainer 500 along the longitudinal axis 501 to further move the seal retainer 500 inside the main body. Due to the dual nature of the teeth 520, the teeth then perform a ratcheting function to retain the position of the seal retainer 500 in the presence of forces that are created by the energized seal element, which tend to push the seal retainer 500 apart from the main body.

Figure 6A:
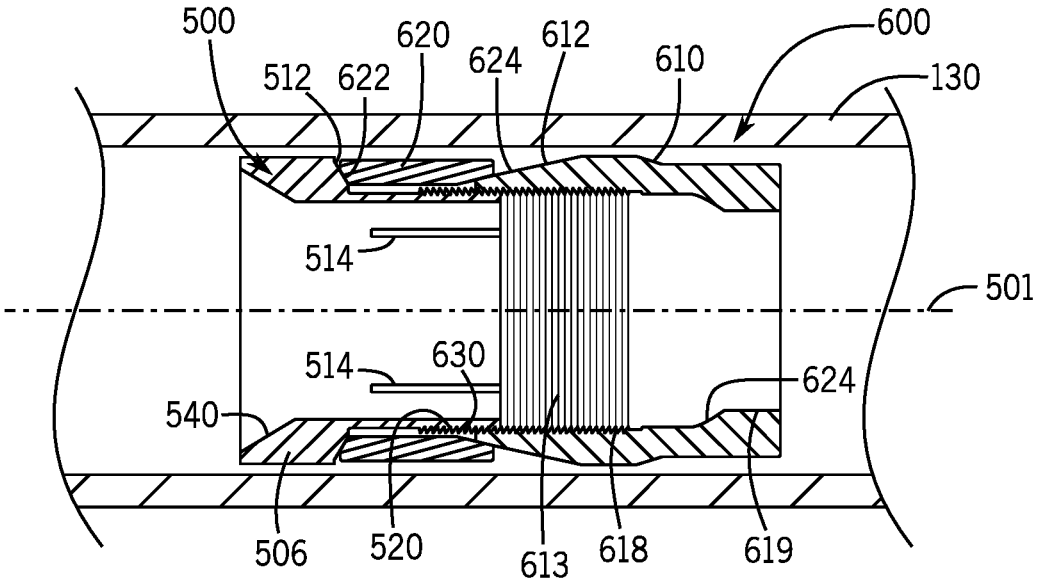
FIG. 6A is a cross-sectional view of a portion of a well illustrating a plug assembly in an unset state according to an example implementation.

FIG. 6A depicts a thin wall plug assembly 600 in accordance with further example implementations. In particular, FIG. 6A depicts the plug assembly 600 in its run-in-hole state. Moreover, as shown in FIG. 6A, the plug assembly 600 includes the seal retainer 500, in accordance with example implementations.

In addition to the seal retainer 500, the plug assembly 600 includes a seal ring 620 and a main body 612. In accordance with some implementations, the seal ring 620 may be a slotted metal sealing ring, such as the one described in U.S. patent application Ser. No. 15/153,085, entitled "METAL SEALING DEVICE," which was filed on May 12, 2016, and is hereby incorporated by reference in its entirety.

Referring to FIG. 6A in conjunction with FIG. 5B, in accordance with some implementations, the upper portion 506 of the seal retainer 500 includes an outer, downwardly facing annular inclined surface 512, which is constructed to contact an inner, upwardly facing annular inclined surface 622 of the seal ring 620. Moreover, the seal ring 620 further includes an inner, downwardly facing annular inclined surface 624, which is constructed to contact an outer, upwardly facing annular inclined surface 612 of the main body 610. Due to the contacting surfaces 512, 622, 612 and 624, in response to the seal retainer 500 being driven toward the main body 610 by a setting tool, radial and axial forces are exerted on the seal ring 620 to energize the seal ring 620 against the tubing string wall and energize the seal ring 620 against the main body 610, thereby forming corresponding fluid seals. The outer teeth 520 of the seal retainer 500 engage inner teeth 613 of the main body 610 to lock in the set position of the seal ring 620. For this particular implementation, the seal ring 620 both forms fluid seals and secures the plug assembly 600 to the tubing string 130. In accordance with further example implementations, the plug assembly 600 may contain a separate gripping member, similar to the plug assembly 300 of FIG. 3. Moreover, in accordance with further example implementations, the plug assembly may contain radial openings for corresponding shear pins to initially secure the setting tool to the plug assembly 600, similar to the arrangement described above in connection with the plug assembly 300.

Figure 6B:
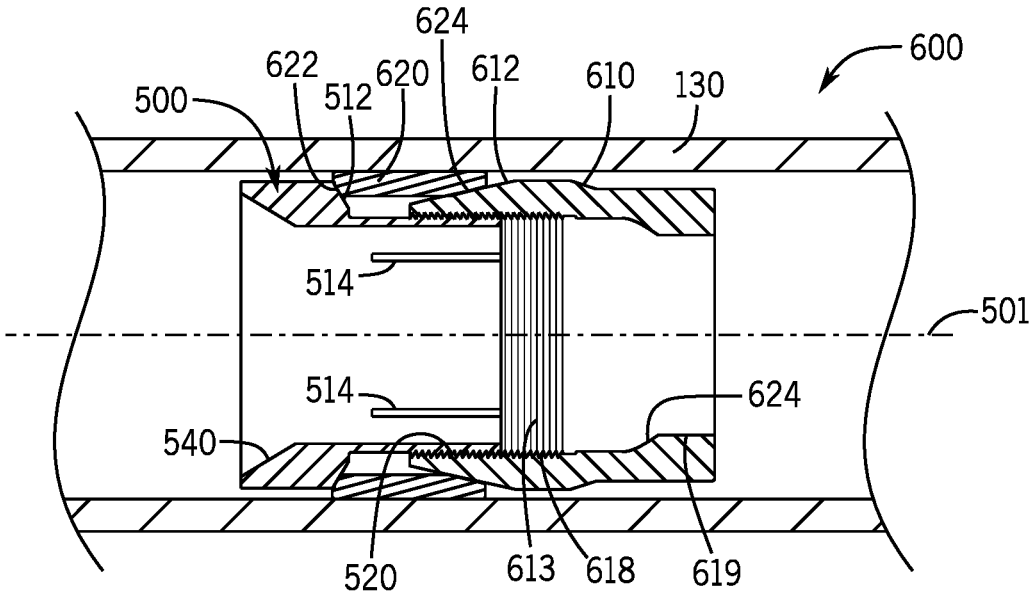
FIG. 6B is a cross-sectional view of the portion of the well of FIG. 6A illustrating the plug assembly in a set state according to an example implementation.

As depicted in FIGS. 6A and 6B, the main body 612 includes an internal seat 624 for purposes of forming a non-wedging surface for receiving an untethered object, such as an activation ball.

Figure 7:
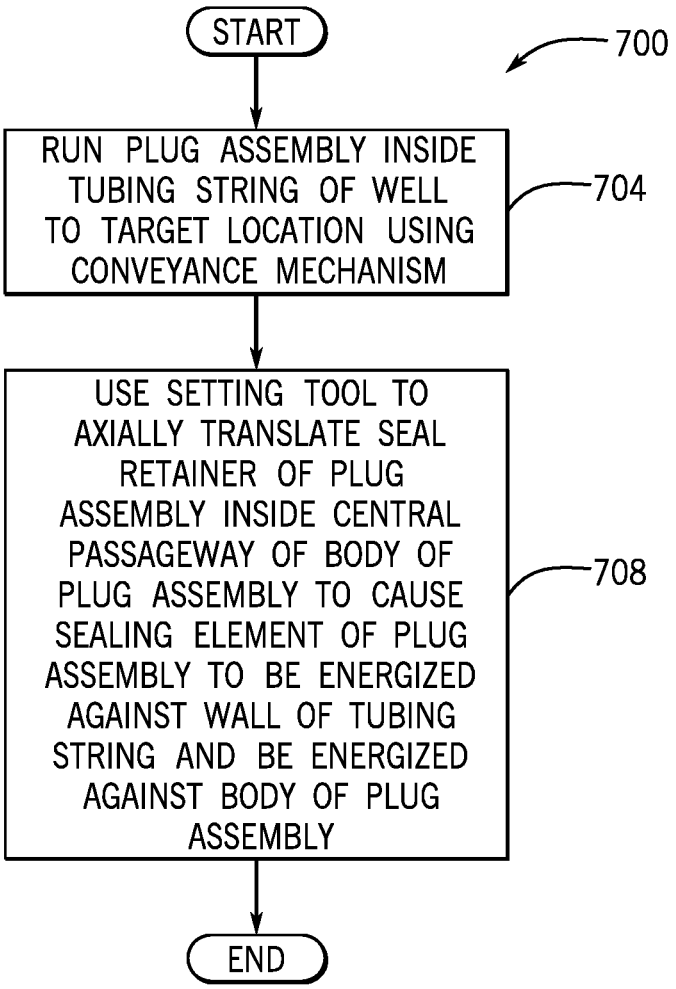
FIG. 7 is a flow diagram depicting a technique to use a ratcheting seal retainer in connection with a plug assembly according to an example implementation.

Thus, referring to FIG. 7, in accordance with example implementations, a technique 700 includes running (block 704) a plug assembly inside a tubing string of a well to a target location using a conveyance mechanism. The technique 700 further includes using (block 708) a setting tool to axially translate a seal retainer of the plug assembly inside a central passageway of the body of the plug assembly to cause a sealing element of the plug assembly to be energized against a wall of the tubing string and be energized against a body of the plug assembly.

In accordance with example implementations, any of the plug assemblies that are described herein as well as any of the untethered objects may be at least partially formed from a dissolvable, or degradable, material, which means that the fluid barrier formed from the object disappears with the passage of time. In this manner, the degradable material is constructed to remain intact and structurally sound for a certain period of time (a few days, weeks, or months, as examples) for purposes of allowing a downhole operation to be performed in which relies on the fluid barrier formed by the plug assembly and untethered object. However, eventually, the degradable material(s) degrade to an extent that removes the fluid barrier. In accordance with example implementations, the degradable material(s) of the plug assembly may be constructed to degrade at a slower rate than the activation ball. For example, the activation ball may be constructed to degrade within a day or two, whereas the material(s) of the plug assembly may be constructed to degrade in a relatively longer timeframe such as a week, several weeks, and so forth.

In accordance with some implementations, the degradable material may be a dissolvable or degradable alloy similar to or the same as one or more of the alloys that are discussed in the following patents and patent applications, which have an assignee in common with the present application: U.S. Pat. No. 7,775,279, entitled, "DEBRIS-FREE PERFORATING APPARATUS AND TECHNIQUE," which issued on Aug. 17, 2010; U.S. Pat. No. 8,211,247, entitled, "DEGRADABLE COMPOSITIONS, APPARATUS COMPOSITIONS COMPRISING SAME, AND A METHOD OF USE," which issued on Jul. 3, 2012; PCT Application Pub. No. WO 2016/085798, entitled, "SHAPING DEGRADABLE MATERIAL," having a publication date of Jun. 2, 2016; PCT Application Pub. No. WO 2016/085804, entitled, "SEVERE PLASTIC DEFORMATION OF DEGRADABLE MATERIAL," having a publication date of Jun. 2, 2016; PCT Application Pub. No. WO 2016/085806, entitled, "BLENDING OF WATER REACTIVE POWDERS," having a publication date of Jun. 2, 2016; PCT Application Pub. No. WO 2015/184041, entitled, "DEGRADABLE POWDER BLEND," having a publication date of Dec. 3, 2015; and PCT Application Pub. No. WO 2015/184043, entitled, "DEGRADABLE HEAT TREATABLE COMPONENTS," having a publication date of Dec. 3, 2015.

While the present techniques have been described with respect to a number of embodiments, it will be appreciated that numerous modifications and variations may be applicable therefrom. It is intended that the appended claims cover all such modifications and variations as fall within the scope of the present techniques.

What is claimed is:

1. A method comprising:

running a plug assembly inside a tubing string of a well;

setting the plug assembly, wherein the setting comprises pushing a seal retainer inside a body of the plug assembly and using a ratcheting mechanism to lock the position of the seal retainer relative to the position of the body;

deploying an untethered object in the tubing string;

communicating the untethered object into a passageway of the plug assembly to land the untethered object in a seat of the plug assembly, the passageway having a maximum cross-sectional dimension that is larger than a maximum cross-sectional dimension of the untethered object, wherein the untethered object is entirely contained within the passageway of the plug assembly when landed in the seat of the plug assembly; and using the landed untethered object to form a fluid barrier in the tubing string.

2. The method of claim 1, wherein communicating the untethered object into the passageway comprises receiving the untethered object in the seat to form a non-interference fit with the untethered object.

3. The method of claim 2, wherein the untethered object comprises an activation ball having an outer diameter, communicating the untethered object into the passageway comprises communicating the activation ball into the passageway of the plug assembly having an inner diameter larger than the outer diameter of the activation ball, and the seat comprises a restriction in the passageway.

4. The method of claim 1, wherein running the plug assembly inside the tubing string comprises running a plug assembly comprising a material constructed to degrade in a time interval less than one month.

5. The method of claim 4, wherein deploying the untethered object comprising a material constructed to degrade in a time interval less than the time interval in which the material of the plug assembly degrades.

6. The method of claim 1, further comprising performing a stimulation operation in the well, wherein performing the stimulation operation comprises diverting fluid using the fluid barrier.

7. A plug assembly usable with a well, comprising:

a tubular main body;

a sealing ring to circumscribe the main body; and a tubular seal retainer to be axially translated inside a central passageway of the body to cause the sealing ring to be energized against a wall of a tubing string surrounding the sealing ring and be energized against the main body, wherein the seal retainer of the plug assembly is adapted to be engaged by a setting tool to compress the sealing ring between the seal retainer and the main body to exert radial and axial forces on the sealing ring.

8. The plug assembly of claim 7, wherein the main body comprises a seat to receive an untethered object to form a fluid barrier inside the tubing string.

9. The plug assembly of claim 7, wherein the seal retainer comprises an outer spirally extending thread, the main body comprises an inner spirally extending thread, and the spirally extending thread of the seal retainer is adapted to engage the spirally extending thread of the body.

10. The plug assembly of claim 9, wherein the seal retainer comprises at least one axially extending slot to adapt the spirally extending threads to engage each other in a ratcheting connection.

11. An apparatus comprising:

a tubing string;

a conveyance mechanism;

a plug assembly to be run downhole inside the tubing string using the conveyance mechanism, wherein the plug assembly comprises:

a tubular main body;

a sealing ring to circumscribe the main body; and a tubular seal retainer to be axially translated inside a central passageway of the body to cause the sealing ring to be energized against a wall of a tubing string surrounding the sealing ring and be energized against the main body; and a setting tool to force the seal retainer of the plug assembly against the sealing ring to radially expand the sealing ring to energize the sealing ring against the tubing string and axially translate the sealing ring to energize the sealing ring against the main body.

12. The apparatus of claim 11, wherein the main body comprises a seat to receive an untethered object to form a fluid barrier, wherein the seat forms a non-interference fit between the untethered object and the seat.

* * * * *